US011760954B2

(12) United States Patent
Yamamoto et al.

(10) Patent No.: US 11,760,954 B2
(45) Date of Patent: Sep. 19, 2023

(54) LUBRICANT COMPOSITION AND LUBRICATING OIL COMPOSITION CONTAINING SAID LUBRICANT COMPOSITION

(71) Applicant: ADEKA CORPORATION, Tokyo (JP)

(72) Inventors: Kenji Yamamoto, Tokyo (JP); Shuhei Igarashi, Tokyo (JP); Ryou Hanamura, Tokyo (JP)

(73) Assignee: ADEKA CORPORATION, Tokyo (JP)

( * ) Notice: Subject to any disclaimer, the term of this patent is extended or adjusted under 35 U.S.C. 154(b) by 0 days.

(21) Appl. No.: 16/764,952

(22) PCT Filed: Nov. 27, 2018

(86) PCT No.: PCT/JP2018/043518

§ 371 (c)(1),
(2) Date: May 18, 2020

(87) PCT Pub. No.: WO2019/111753

PCT Pub. Date: Jun. 13, 2019

(65) Prior Publication Data

US 2020/0347317 A1 Nov. 5, 2020

(30) Foreign Application Priority Data

Dec. 5, 2017 (JP) ..... 2017-233180
Apr. 19, 2018 (JP) ..... 2018-080662

(51) Int. Cl.

| | |
|---|---|
| ***C10M 171/06*** | (2006.01) |
| ***C10M 171/04*** | (2006.01) |
| *C10N 20/06* | (2006.01) |
| *C10N 30/06* | (2006.01) |

(52) U.S. Cl.
CPC ..... *C10M 171/06* (2013.01); *C10M 171/04* (2013.01); *C10M 2209/084* (2013.01); *C10N 2020/06* (2013.01); *C10N 2030/06* (2013.01)

(58) Field of Classification Search
CPC ..... C10M 171/06; C10M 171/04; C10M 2209/084; C10N 2030/06; C10N 2020/06
See application file for complete search history.

(56) References Cited

U.S. PATENT DOCUMENTS

2007/0135317 A1* 6/2007 Jao ..... B82Y 30/00 508/410
2010/0099590 A1* 4/2010 Liu ..... B82Y 30/00 508/478

FOREIGN PATENT DOCUMENTS

| | | |
|---|---|---|
| JP | 7-53983 | 2/1995 |
| JP | 10-17586 | 1/1998 |
| JP | 2002-12881 | 1/2002 |
| JP | 2005-325241 | 11/2005 |
| JP | 2007-162023 | 6/2007 |
| JP | 2012-41407 | 3/2012 |
| JP | 2017-141439 | 8/2017 |
| WO | 2015/076103 | 5/2015 |

OTHER PUBLICATIONS

International Search Report dated Feb. 26, 2019 in International (PCT) Application No. PCT/JP2018/043518.
Examination Report dated Oct. 6, 2021 in corresponding Indian Patent Application No. 202037027825, with English translation.

* cited by examiner

*Primary Examiner* — Taiwo Oladapo
(74) *Attorney, Agent, or Firm* — Wenderoth, Lind & Ponack, L.L.P.

(57) ABSTRACT

A lubricant composition containing a base oil and organic fine particles substantially consisting of the three elements of carbon, hydrogen and oxygen and having a proportion of particles having a particle diameter of 10 nm to 10 μm of 90% or greater, wherein the content of the organic fine particles is 0.01 to 50 parts by mass relative to 100 parts by mass of the base oil.

5 Claims, No Drawings

LUBRICANT COMPOSITION AND LUBRICATING OIL COMPOSITION CONTAINING SAID LUBRICANT COMPOSITION

TECHNICAL FIELD

The present invention relates to a lubricant composition which exhibits high lubrication performance, is highly safe, and has less adverse effect on the environment, and to a lubricating oil composition containing the lubricant composition.

BACKGROUND ART

Lubricating oils containing additives such as extreme pressure agents, friction modifiers and wear prevention agents are used in all sorts of equipment and machinery in order to decrease friction, wear and seizing as far as possible and to extend the service life of the equipment and machinery. In general, organic molybdenum compounds are well known as compounds that exhibit a high friction reduction effect among existing friction modifiers (see PTL 1 and 2). It is said that organic molybdenum compounds form a film of molybdenum disulfide on sliding surfaces where metals come into contact with each other, such as boundary lubrication regions, that is, locations where a certain degree of temperature or load is applied, and exhibit a friction reduction effect, and this effect has been confirmed with all sorts of lubricating oils, such as engine oils. However, organic molybdenum compounds do not necessarily exhibit a friction reduction effect when used under all conditions, and there are cases where a sufficient friction reduction effect cannot be exhibited by organic molybdenum compounds in isolation, depending on application or intended use, and cases where this effect is weakened and friction reduction is difficult under harsh conditions where a large contact surface pressure is applied, such as point contact.

In particular, as examples of additives used for reducing friction under harsh conditions where a particularly large contact surface pressure is applied, such as point contact, PTL 3, for example, discloses extreme pressure agents such as lead naphthenate, sulfurized fatty acid esters, sulfurized sperm oil, terpene sulfide, dibenzyl disulfides, chlorinated paraffins, chloronaphthazantate, tricresyl phosphate, tributyl phosphate, tricresyl phosphite, n-butyl di-n-octyl phosphinate, di-n-butyldihexyl phosphonate, di-n-butylphenyl phosphonate, dibutylphosphoroamidate and amine dibutyl phosphate. In addition, PTL 4 discloses extreme pressure agents such as sulfurized oils and fats, olefin polysulfides, dibenzyl sulfide, monooctyl phosphate, tributyl phosphate, triphenyl phosphite, tributyl phosphite, thiophosphate esters, thiophosphoric acid metal salts, thiocarbamic acid metal salts and acidic phosphate ester metal salts. However, these known extreme pressure agents contain metal elements such as lead and zinc and elements such as chlorine, sulfur and phosphorus, and therefore cause problems such as these elements being a cause of corrosion of sliding surfaces and having an adverse effect on the environment in the disposal of lubricating oils.

In order to solve such problems, PTL 5 discloses an extreme pressure agent for lubricating oils, which includes a copolymer containing an alkyl acrylate and a hydroxyalkyl acrylate as essential constituent monomers, as an extreme pressure agent for lubricating oils which exhibits excellent solution stability and extreme pressure performance. In addition, PTL 6 indicates that a lubricity improver for fuel oils, which contains a fatty acid and a copolymer including a monomer such as a (meth)acrylate and a hydroxyl group-containing vinyl monomer as essential constituent monomers, exhibits improved lubrication properties without causing clouding, solidification or precipitation of crystals even in low temperature conditions such as during winter or in cold regions. When this type of lubricating oil is added to a base oil, if precipitation, white turbidness or solidification occur and a completely dissolved state is not achieved, it is thought that these characteristics cannot be exhibited and use in applications such as extreme pressure agents and lubricity improvers is not possible. However, extreme pressure agents and lubricity improvers used by being dissolved in this type of base oil suffered from problems such as not achieving a sufficient friction reduction effect and not improving the friction reduction performance of a lubricating oil.

PRIOR ART DOCUMENTS

Patent Literature

[PTL 1] Japanese Patent Laid-Open No. H07-53983
[PTL 2] Japanese Patent Laid-Open No. H10-17586
[PTL 3] Japanese Patent Laid-Open No. 2002-012881
[PTL 4] Japanese Patent Laid-Open No. 2005-325241
[PTL 5] Japanese Patent Laid-Open No. 2012-041407
[PTL 6] Japanese Patent Laid-Open No. 2017-141439

SUMMARY OF THE INVENTION

Problem to be Solved by the Invention

Therefore, the problem to be solved by the present invention is to provide: a lubricant composition which exhibits lubrication performance equivalent or better than existing extreme pressure agents that contain metal elements or the like, and substantially consists of the three elements of carbon, hydrogen and oxygen, thereby exhibiting greater safety and having less adverse effect on the environment; and a lubricating oil composition containing the lubricant composition.

Means for Solving the Problem

As a result of diligent research, the present inventors have discovered a lubricant composition that exhibits high lubrication performance, and thereby completed the present invention.

That is, the present invention is a lubricant composition containing a base oil and organic fine particles substantially consisting of the three elements of carbon, hydrogen and oxygen and having a proportion of particles having a particle diameter of 10 nm to 10 μm of 90% or greater, wherein the content of the organic fine particles is 0.01 to 50 parts by mass relative to 100 parts by mass of the base oil.

Effects of the Invention

The advantageous effect of the present invention is to provide: a lubricant composition which exhibits equivalent or better lubrication performance compared to existing extreme pressure agents that contain metal elements or the like, and substantially consists of the three elements of carbon, hydrogen and oxygen, thereby exhibiting greater safety; and a lubricating oil composition containing the lubricant composition.

BEST MODE FOR CARRYING OUT THE INVENTION

The type of base oil used in the lubricant composition according to the present invention is not particularly limited, and can be selected as appropriate from among mineral base oils, chemically synthesized base oils, plant- and animal-based base oils, and mixed base oils thereof, depending on the intended use of the invention and conditions. Examples of mineral oils include distillates obtained by atmospheric distillation of paraffin-based crude oil, naphthene-based crude oil, mixed crude oil or aromatic crude oil or by vacuum distillation of atmospheric distillation residues, and refined oils obtained by refining these distillates using conventional methods, and specific examples include solvent refined oils, hydrogenated refined oils, dewaxed oils and oils treated with China clay. Examples of chemically synthesized base oils include poly-α-olefins, polyisobutylene (polybutene), monoesters, diesters, polyol esters, silicic acid esters, polyalkylene glycols, polyphenyl ethers, silicones, fluorinated compounds, alkylbenzene compounds and GTL base oils, and of these, poly-α-olefins, polyisobutylene (polybutene), diesters, polyol esters, and the like, can be widely used, and examples of poly-α-olefins include compounds obtained by polymerizing or oligomerizing hexene, 1-octene, 1-nonene, 1-decease, 1-dodecene, 1-tetradecene, and the like, and compounds obtained by hydrogenating these, examples of diesters include diesters of dibasic acids such as glutaric acid, adipic acid, azelaic acid, sebacic acid and dodecanedicarboxylic acid and alcohols such as 2-ethylhexanol, octanol, decanol, dodecanol and tridecanol, and examples of polyol esters include esters of polyols such as neopentyl glycol, trimethylolethane, trimethylolpropane, pentaerythritol, dipentaerythritol and tripentaerythritol and fatty acids such as caproic acid, caprylic acid, lauric acid, capric acid, myristic acid, palmitic acid, stearic acid and oleic acid. Examples of plant- and animal-based base oils include plant-based oils and fats, such as castor oil, olive oil, cocoa butter, sesame oil, rice bran oil, safflower oil, soy bean oil, camellia oil, corn oil, rape seed oil, palm oil, palm kernel oil, sunflower oil, cottonseed oil and coconut oil, and animal-based oils and fats, such as beef tallow, lard, butterfat, fish oils and whale oil, and it is possible to use one of these or a combination of two or more types thereof. If necessary, it is possible to use a highly refined base oil obtained by refining these base oils to a high degree so as to lower the content of impurities such as sulfur. Of these, it is preferable to incorporate chemically synthesized base oils such as poly-α-olefins, polyisobutylene (polybutene), diesters and polyol esters, more preferable to incorporate hydrocarbon oils such as poly-α-olefins, and further preferable to use highly refined base oils obtained from these base oils. In the present invention, it is particularly preferable to incorporate a base oil including a hydrocarbon oil at a quantity of 50 mass % or more relative to the overall base oil quantity so as to advantageously control solubility and dispersibility of the copolymer (A) in the base oil, and more preferable to incorporate such a base oil at a quantity of 90 mass % or greater relative to the overall base oil quantity.

From the perspectives of lubrication characteristics and handleability of the lubricant composition, the Hildebrand solubility parameter of the base oil used in the lubricant composition according to the present invention is preferably 15.0 to 18.0 $(MPa)^{1/2}$, more preferably 15.5 to 17.5 $(MPa)^{1/2}$, and further preferably 16.0 to 17.0 $(MPa)^{1/2}$. Here, the "Hildebrand solubility parameter" mentioned in this description is a parameter that serves as an indicator of the solubility of a two-component solution, is defined on the basis of regular solution theory, and indicates the strength of bonding in molecule groups. When a plurality of substances are mixed, as the Hildebrand solubility parameters of the substances become more similar, the substances tend to be better mixed/dissolved, and as the difference in Hildebrand solubility parameter between the substances increases, the substances tend to be difficult to mix or do not dissolve. The Hildebrand solubility parameter (δ) depends on the type and number of atoms and atomic groups present in the molecular structures in question, and is therefore calculated using the following Formula 1 by means of the Fedors method on the basis of the group contribution method.

[Formula 1]

$$\delta=(E/V)^{1/2}=(\Sigma\Delta e_i/\Sigma v_i)^{1/2}[(MPa)^{1/2}] \quad (1)$$

wherein E denotes the molar cohesive energy [J/mol], V denotes the molar volume [$cm^3$/mol], $\Delta e_i$ denotes the partial molar cohesive energy [J/mol], and $v_i$ denotes the partial molar volume [$cm^3$/mol].

Here, in view of the numerical values shown in Table 1 below, which are parameters used in the Fedors method, it is possible to use numerical values corresponding to the types of atom and atomic group in molecular structures for the values of $\Delta e_i$ and $v_i$.

TABLE 1

| Atom or atomic group | $\Delta e_1$ [cal/mol] | $V_i$ [$cm^3$/mol] |
|---|---|---|
| $CH_3$ | 1125 | 33.5 |
| $CH_2$ | 1180 | 16.1 |
| CH | 820 | −1.0 |
| C | 350 | −19.2 |
| $H_2C$═ | 1030 | 28.5 |
| —CH═ | 1030 | 13.5 |
| C═ | 1030 | −5.5 |
| HC≡ | 920 | 27.4 |
| —C≡ | 1690 | 6.5 |
| Phenyl | 7630 | 71.4 |
| Phenylene (o.m.p) | 7630 | 52.4 |
| Phenyl (trisubstituted) | 7630 | 33.4 |
| Phenyl (tetrasubstituted) | 7630 | 14.4 |
| Phenyl (pentasubstituted) | 7630 | −4.6 |
| Phenyl (hexasubstituted) | 7630 | −23.6 |
| Ring closure 5 or more atoms | 250 | 16 |
| Ring closure 3 or 4 more atoms | 750 | 18 |
| $CO_3$ (carbonate) | 4200 | 22.0 |
| COOH | 6600 | 28.5 |
| $CO_2$ | 4300 | 18.0 |
| CO | 4150 | 10.8 |
| CHO (aldehyde) | 5100 | 22.3 |
| $CO_2CO_2$ (oxalate) | 6400 | 37.3 |
| $C_2O_3$ (anhydride) | 7300 | 30.0 |
| HCOO (formate) | 4300 | 32.5 |
| $CONH_2$ | 10000 | 17.5 |
| CONH | 8000 | 9.5 |
| CON | 7050 | −7.7 |
| HCON | 6600 | 11.3 |
| HCONH | 10500 | 27.0 |
| COCl | 5000 | 38.0 |
| $NH_2$ | 3000 | 19.2 |
| NH | 2000 | 4.5 |
| N | 1000 | −9.0 |
| —N═ | 2800 | 5.0 |
| CN | 6100 | 24.0 |
| $NO_2$ (aliphatic) | 7000 | 24.0 |
| $NO_2$ (aromatic) | 3670 | 32.0 |
| $NO_3$ | 5000 | 33.5 |
| $NO_2$ (nitrite) | 2800 | 33.5 |
| CSN | 4800 | 37.0 |
| NCO | 6800 | 35.0 |

TABLE 1-continued

| Atom or atomic group | $\Delta e_1$ [cal/mol] | $V_i$ [$cm^3$/mol] |
|---|---|---|
| $NF_2$ | 1830 | 33.1 |
| $NF_2$ | 1210 | 24.5 |
| O | 800 | 3.8 |
| OH | 7120 | 10.0 |
| OH (disubstituted or on adjacent C atoms) | 5220 | 13.0 |

Parameters for Fedors Method

Next, the organic fine particles used in the lubricant composition according to the present invention are a compound substantially consisting of the three elements of carbon, hydrogen and oxygen. Here, the statement "substantially consisting of the three elements of carbon, hydrogen and oxygen" in this specification means that the organic fine particles are constituted only from compounds that do not intentionally contain structures containing elements other than carbon, hydrogen and oxygen in the molecule. That is, inclusion of trace quantities of other elements, such as metal elements derived from a catalyst or the like added when said compound is synthesized, is acceptable. Such organic fine particles may be, for example, a polymer obtained by polymerizing a single polymerizable monomer consisting of the three elements of carbon, hydrogen and oxygen, or a copolymer obtained by polymerizing different polymerizable monomers consisting of the three elements of carbon, hydrogen and oxygen. In addition, a polymerizable monomer consisting of carbon and hydrogen may be contained in such cases.

Polymerizable monomers that constitute the polymer or copolymer that constitutes the organic fine particles are not particularly limited as long as these monomers are polymerizable monomers which have a polymerizable functional group in the molecule and substantially consist of carbon and hydrogen or polymerizable monomers consisting of the three elements of carbon, hydrogen and oxygen. Here, examples of polymerizable functional groups include vinyl groups, acrylate groups and methacrylate groups. In addition, polymerizable monomers are not particularly limited, but examples thereof include alkyl acrylates and acrylic methacrylates represented by the following formula (1); hydroxyalkyl acrylates and hydroxyalkyl methacrylates represented by the following formula (2); alkyl acrylates and acrylic methacrylates represented by the following formula (3); aromatic vinyl monomers having 8 to 14 carbon atoms; aliphatic vinyl monomers such as vinyl acetate, vinyl propionate, vinyl octanoate, methyl vinyl ether, ethyl vinyl ether and 2-ethylhexyl vinyl ether; and acrylic acid esters such as methyl acrylate, ethyl acrylate and propyl acrylate.

[Chemical Formula 1]

(1)

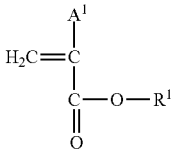

wherein $R^1$ represents an alkyl group having 4 to 18 carbon atoms and $A^1$ represents a hydrogen atom or a methyl group.

[Chemical Formula 2]

(2)

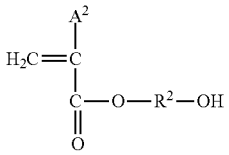

wherein $R^2$ represents an alkylene group having 2 to 4 carbon atoms and $A^2$ represents a hydrogen atom or a methyl group.

[Chemical Formula 3]

(3)

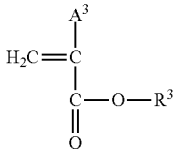

wherein $R^3$ represents an alkyl group having 1 to 3 carbon atoms and $A^3$ represents a hydrogen atom or a methyl group.

Examples of $R^1$ in the formula (1) include straight chain alkyl groups such as butyl groups, pentyl groups, hexyl groups, heptyl, octyl groups, nonyl groups, decyl groups, undecyl groups, dodecyl groups, tridecyl groups, tetradecyl groups, pentadecyl groups, hexadecyl groups, heptadecyl groups and octadecyl groups; and branched alkyl groups such as branched butyl groups, branched pentyl groups, branched hexyl groups, branched heptyl, branched octyl groups, branched nonyl groups, branched decyl groups, branched undecyl groups, branched dodecyl groups, branched tridecyl groups, branched tetradecyl groups, branched pentadecyl groups, branched hexadecyl groups, branched heptadecyl groups and branched octadecyl groups.

In addition, $A^1$ represents a hydrogen atom or a methyl group, and is preferably a hydrogen atom from the perspective of lubrication performance of the obtained lubricant composition.

Examples of $R^2$ in the formula (2) include an ethylene group, a propylene group, a butylene group, a methylethylene group, a methylpropylene group and a dimethylethylene group. Of these, an alkylene group having 2 to 3 carbon atoms is preferred, and an ethylene group is more preferred.

In addition, $A^2$ represents a hydrogen atom or a methyl group, and is preferably a hydrogen atom from the perspective of lubrication performance of the obtained lubricant composition.

Examples of $R^3$ in the formula (3) above include a methyl group, an ethyl group and a propyl group. Of these, a methyl group or an ethyl group is preferred, and a methyl is more preferred.

In addition, $A^3$ represents a hydrogen atom or a methyl group, and is preferably a hydrogen atom from the perspective of lubrication performance of the obtained lubricant composition.

Furthermore, examples of aromatic vinyl monomers having 8 to 14 carbon atoms include monocyclic monomers such as styrene, vinyltoluene, 2,4-dimethylstyrene and 4-ethylstyrene; and polycyclic monomers such as 2-vinylnaphthalene. Of these, it is preferable to incorporate styrene from the perspective of lubrication performance of the obtained lubricant composition.

From the perspective of lubrication performance of the obtained lubricant composition, the polymer or copolymer that constitutes the organic fine particles is preferably a copolymer containing at least a hydroxyalkyl acrylate or hydroxyalkyl methacrylate represented by the formula (2) or an aromatic vinyl monomer having 8 to 14 carbon atoms. That is, the organic fine particles used in the lubricant composition according to the present invention are preferably a copolymer containing at least units obtained by polymerizing a hydroxyalkyl acrylate or hydroxyalkyl methacrylate represented by the formula (2) or an aromatic vinyl monomer having 8 to 14 carbon atoms. Here, the total content in the copolymer of units obtained by polymerizing one or more of a hydroxyalkyl acrylate or hydroxyalkyl methacrylate represented by the formula (2) or an aromatic vinyl monomer having 8 to 14 carbon atoms is preferably 20 to 100 mol %, more preferably 40 to 95 mol %, and further preferably 50 to 90 mol %, of all the units that constitute the copolymer.

As a result of a polymerization reaction, the hydroxyalkyl acrylate or hydroxyalkyl methacrylate represented by general formula (2) is present in the polymer as a unit (b-1) represented by the formula (4) below:

[Chemical Formula 4]

(4)

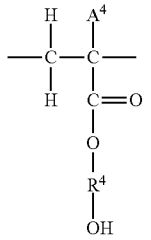

wherein $R^4$ represents an alkylene group having 2 to 4 carbon atoms and $A^4$ represents a hydrogen atom or a methyl group.

From the perspective of lubrication performance of the obtained lubricant composition, the polarity term $\delta_p$ of the Hansen solubility parameter of the unit (b-1) represented by general formula (4) is preferably 4.5 to 12.0 $(MPa)^{1/2}$, more preferably 5.5 to 11.0 $(MPa)^{1/2}$, and further preferably 6.5 to 10.0 $(MPa)^{1/2}$. Here, the term "Hansen solubility parameter" mentioned in this specification is used as a measure of affinity between substances by separating the strength of bonding between molecule groups into three intermolecular force elements, namely London dispersion energy, dipole-dipole interaction energy and hydrogen bonding energy, and is a parameter that includes a dispersion term $\delta_d$ that denotes the London dispersion energy, a polarity term $\delta_p$ that denotes the dipole-dipole interaction energy and a hydrogen bonding term $\delta_h$ that denotes the hydrogen bonding energy. Of these, the polarity term $\delta_p$ that denotes the dipole-dipole interaction energy is a term whereby the value of $\delta_p$ increases as polarity within a molecule increases. When a plurality of substances are mixed, as the values of the individual parameters in the Hansen solubility parameters of the substances become more similar, the substances tend to be better mixed/dissolved, and as the difference in the values of the individual parameters between the substances increases, the substances tend to be difficult to mix or do not dissolve.

The dispersion term $\delta_d$, polarity term $\delta_p$ and hydrogen bonding term $\delta_h$ of the Hansen solubility parameter depend on the type and number of atoms and atomic groups present in the molecular structures in question, and are calculated using the following Formulae (2) to (4) below by means of the van Krevelen & Hoftyzer method on the basis of the group contribution method.

[Formula 2]

$$\delta_d=(\Delta E_d/V)^{1/2}=\Sigma F_{d\,i}/\Sigma V_i\ [(MPa)^{1/2}] \quad (2)$$

$$\delta_p=(\Delta E_p/V)^{1/2}=(\Sigma F_{pi}^2)^{1/2}/\Sigma V_i\ [(MPa)^{1/2}] \quad (3)$$

$$\delta_h=(\Delta E_h/V)^{1/2}=(\Sigma E_{hi}/\Sigma V_i)^{1/2}\ [(MPa)^{1/2}] \quad (4)$$

wherein $\Delta E_d$ represents the dispersed molar attraction constant $[(MJ/m^3)^{1/2}/mol]$, $\Delta E_p$ represents the partial polar molar attraction constant $[(MJ/m^3)^{1/2}/mol]$, $\Delta E_h$ represents the partial hydrogen bonding energy [J/mol], V represents the molar volume $[cm^3/mol]$, $F_{di}$ represents the partial dispersed molar attraction constant $[(MJ/m^3)^{1/2}/mol]$, $V_i$ represents the partial molar volume $[cm^3/mol]$, $F_{pi}$ represents the partial polar molar attraction constant $[(MJ/m^3)^{1/2}/mol]$, and $E_{hi}$ represents the partial hydrogen bonding energy [J/mol].)

Here, in view of the numerical values shown in Table 2 below, which are parameters used in the van Krevelen & Hoftyzer method, it is possible to use numerical values corresponding to the types of atom and atomic group in molecular structures for the values of $F_{di}$, $V_i$, $F_{pi}$ and $E_{hi}$.

TABLE 2

Parameters for van Krevelen & Hoftyzer method

| Atom or atomic group | $F_{di}$ [J/mol] | $F_{pi}$ [J/mol] | $E_{hi}$ [J/mol] | $V_i$ [$cm^3$/mol] |
|---|---|---|---|---|
| —$CH_3$ | 420 | 0 | 0 | 31.7 |
| —$CH_2$— | 270 | 0 | 0 | 16.1 |
| >CH— | 80 | 0 | 0 | −1.0 |
| >C< | −70 | 0 | 0 | −19.2 |
| =$CH_2$ | 403 | 94 | 143 | 28.5 |
| =CH— | 223 | 70 | 143 | 13.5 |
| =C< | 70 | 0 | 0 | −5.5 |
| —$C_6H_{11}$ | 1620 | 0 | 0 | 95.5 |
| —$C_6H_5$ | 1499 | 110 | 205 | 75.4 |
| —$C_6H_4$ (o.m.p) | 1319 | 110 | 205 | 60.4 |
| —F | 221 | 542 | — | 18.0 |
| —F (disubstituted, >$CF_2$) | 221 | 542 | — | 20.0 |
| —F (trisubstituted, —$CF_3$) | 221 | 542 | — | 22.0 |
| —Cl | 450 | 550 | 400 | 24.0 |
| —Cl (disubstituted, >$CCl_2$) | 450 | 550 | 400 | 26.0 |
| —Cl (trisubstituted, —$CCl_3$) | 450 | 550 | 400 | 27.3 |
| —Br | 550 | 614 | 1023 | 29.0 |
| —Br (disubstituted, >$CBr_2$) | 550 | 614 | 1023 | 31.0 |
| —Br (trisubstituted, —$CBr_3$) | 550 | 614 | 1023 | 32.0 |
| —I | 655 | 655 | 2046 | 32.2 |
| —CN | 430 | 1100 | 2500 | 24.0 |
| —OH | 210 | 500 | 20,000 | 10.0 |
| —OH (disubstituted or on adjacent C atoms) | 210 | 500 | 20,000 | 13.0 |
| —O— | 235 | 409 | 2352 | 3.8 |
| —COH (aldehyde) | 470 | 800 | 4500 | 22.3 |
| >C=O | 290 | 770 | 2000 | 10.5 |
| —COOH | 530 | 420 | 1000 | 28.5 |
| —COO— (ester) | 390 | 490 | 7000 | 18.0 |
| HCOO— (formate) | 530 | — | — | 32.5 |
| —CO—O—CO— (anhydride) | 675 | 1105 | 4838 | 30.0 |
| —$NH_2$ | 280 | 419 | 8400 | 17.9 |
| —NH— | 160 | 210 | 3100 | 4.5 |
| >N= | 20 | 800 | 5000 | −9.0 |
| —$NO_2$ (aliphatic) | 500 | 1070 | 1500 | 24.0 |

TABLE 2-continued

| Parameters for van Krevelen & Hoftyzer method | | | | |
|---|---|---|---|---|
| Atom or atomic group | $F_{di}$ [J/mol] | $F_{pi}$ [J/mol] | $E_{hi}$ [J/mol] | $V_i$ [cm$^3$/mol] |
| —$NO_2$ (aromatic) | 500 | 1070 | 1500 | 32.0 |
| —>SI—O— | 266 | 307 | 921 | 3.8 |
| —S— (sulfide) | 440 | — | — | 12.0 |
| =$PO_4$— (phosphate) | 740 | 1890 | 6352 | 28.0 |
| Ring (5 or more members) | 190 | — | — | 13.5 |
| Ring (3 or 4 members) | 190 | — | — | 18.0 |

In addition, the dispersion term $\delta_d$ and hydrogen bonding term $\delta_h$ of the Hansen solubility parameter of the unit (b-1) are not particularly limited, but from the perspective of lubrication performance of the obtained lubricant composition, the dispersion term $\delta_d$ is preferably 17.5 to 22.0 $(MPa)^{1/2}$, and more preferably 18.0 to 21.0 $(MPa)^{1/2}$, and the hydrogen bonding term $\delta_h$ is preferably 6.5 to 32.0 $(MPa)^{1/2}$, more preferably 8.5 to 24.0 $(MPa)^{1/2}$, and further preferably 9.5 to 20.0 $(MPa)^{1/2}$.

Moreover, as a result of a polymerization reaction, the aromatic vinyl monomer having 8 to 14 carbon atoms is present in the polymer as a unit (b-2) represented by a structure in which a vinyl group forms a single bond.

From the perspective of lubrication performance of the obtained lubricant composition, the dispersion term $\delta_d$ of the Hansen solubility parameter of the unit (b-2) is preferably 17.5 to 22.0 $(MPa)^{1/2}$, and more preferably 18.0 to 21.0 $(MPa)^{1/2}$.

In addition, the polarity term $\delta_p$ and hydrogen bonding term $\delta_h$ of the Hansen solubility parameter of the unit (b-2) are not particularly limited, but from the perspective of lubrication performance of the obtained lubricant composition, the polarity term $\delta_p$ is preferably 0.1 to 5.0 $(MPa)^{1/2}$, and more preferably 0.5 to 4.0 $(MPa)^{1/2}$, and the hydrogen bonding term $\delta_h$ is preferably 0.1 to 5.0 $(MPa)^{1/2}$, and more preferably 0.5 to 4.0 $(MPa)^{1/2}$.

From the perspective of lubrication performance of the obtained lubricant composition, the polymer or copolymer that constitutes the organic fine particles is preferably a copolymer containing the unit (b-1) and the unit (b-2) as constituent units. Here, the compositional ratio of molar proportions of the unit (b-1) and the unit (b-2) in the copolymer is preferably 3:97 to 97:3, more preferably 10:90 to 90:10, further preferably 10:90 to 40:60, and yet more preferably 10:90 to 30:70, provided that the sum of the molar proportions taken to be 100.

In addition, from the perspective of lubrication performance of the obtained lubricant composition, the polymer or copolymer that constitutes the organic fine particles preferably contains a unit (a) obtained by polymerizing an alkyl acrylate or alkyl methacrylate represented by formula (1). Here, the content in the copolymer of the unit (a), which includes the overall content of units obtained by polymerizing one or more alkyl acrylates or alkyl methacrylates represented by the formula (1), is preferably 5 to 70 mol %, more preferably 5 to 50 mol %, further preferably 10 to 40 mol %, and yet more preferably 10 to 30 mol %, of all the units that constitute the copolymer.

As a result of a polymerization reaction, the alkyl acrylate or alkyl methacrylate represented by general formula (1) is present in the polymer as a unit (a) represented by the formula (5) below:

[Chemical Formula 5]

(5)

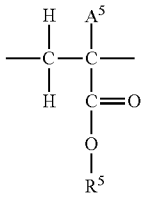

wherein $R^5$ represents an alkyl group having 4 to 18 carbon atoms and $A^5$ represents a hydrogen atom or a methyl group.

Examples of $R^5$ in the formula (5) include straight chain alkyl groups such as butyl groups, pentyl groups, hexyl groups, heptyl, octyl groups, nonyl groups, decyl groups, undecyl groups, dodecyl groups, tridecyl groups, tetradecyl groups, pentadecyl groups, hexadecyl groups, heptadecyl groups and octadecyl groups; and branched alkyl groups such as branched butyl groups, branched pentyl groups, branched hexyl groups, branched heptyl, branched octyl groups, branched nonyl groups, branched decyl groups, branched undecyl groups, branched dodecyl groups, branched tridecyl groups, branched tetradecyl groups, branched pentadecyl groups, branched hexadecyl groups, branched heptadecyl groups and branched octadecyl groups.

In addition, $A^5$ represents a hydrogen atom or a methyl group, and is preferably a hydrogen atom from the perspective of lubrication performance of the obtained lubricant composition.

The polarity term $\delta_p$ of the Hansen solubility parameter of the unit (a) represented by the formula (5) is preferably 0.1 to 4.0 $(MPa)^{1/2}$, more preferably 0.5 to 3.0 $(MPa)^{1/2}$, and further preferably 1.0 to 2.5 $(MPa)^{1/2}$. Moreover, the Hansen solubility parameter is calculated using the method described above.

In addition, the dispersion term $\delta_d$ and hydrogen bonding term $\delta_h$ of the Hansen solubility parameter of the unit (a) are not particularly limited, but from the perspective of lubrication performance of the obtained lubricant composition, the dispersion term $\delta_d$ is preferably 16.6 to 17.8 $(MPa)^{1/2}$, and more preferably 16.8 to 17.6 $(MPa)^{1/2}$, and the hydrogen bonding term $\delta_h$ is preferably 4.0 to 7.0 $(MPa)^{1/2}$, and more preferably 4.4 to 6.0 $(MPa)^{1/2}$.

From the perspective of lubrication performance of the obtained lubricant composition, the organic fine particles used in the lubricant composition according to the present invention preferably include a copolymer containing at least one type of unit (a) and at least one type of unit (b) selected from the group consisting of the unit (b-1) and the unit (b-2). This type of copolymer may contain other units obtained by polymerizing polymerizable monomers other than the polymerizable monomer (a) and the polymerizable monomer (b), but from the perspective of lubrication performance of the obtained lubricant composition, the total content of units including the unit (a) and the unit (b) is preferably 90 mol % or more of all the units that constitute the copolymer, and is most preferably a copolymer substantially consisting of the unit (a) and the unit (b). Here, in cases where the unit (a), the unit (b) or both of these contain units including two or more types of polymerizable monomer, the content is calculated using the total molar quantity of these as the molar quantity of the unit (a) or the unit (b).

The compositional ratio of the unit (a) and the unit (b) in such a copolymer is not particularly limited, but is preferably such that (a):(b) is 10 to 70:30 to 90, more preferably 10 to 50:50 to 90, further preferably 10 to 45:55 to 90, and yet more preferably 10 to 30:70 to 90, provided that the sum of the molar proportions taken to be 100. By setting the compositional ratio of the unit (a) and the unit (b) to fall within such a range, it is possible to advantageously control the solubility and dispersibility of the copolymer and better manifest the lubrication performance of the obtained lubricant composition. In addition, the bonding form of the copolymer is not particularly limited, and the copolymer may be a block copolymer, a random copolymer or a block/random copolymer. In addition, the weight average molecular weight of the copolymer is not particularly limited, but is, for example, preferably 1,000 to 500,000, more preferably 3,000 to 300,000, and further preferably 5,000 to 200,000. If the weight average molecular weight falls within such a range, lubrication performance of the obtained lubricant composition can be better manifested. Moreover, "weight average molecular weight" can be measured by means of GPO (gel permeation chromatography) and determined in terms of styrene.

From the perspective of lubrication performance of the obtained lubricant composition, the difference in the polarity term $\delta_p$ of the Hansen solubility parameter between the unit (a) and the unit (b) that constitute the copolymer is preferably 0.1 to 12.0 $(MPa)^{1/2}$, more preferably 0.2 to 8.0 $(MPa)^{1/2}$, and further preferably 0.5 to 6.0 $(MPa)^{1/2}$. The difference in the polarity term of the Hansen solubility parameter can be adjusted by appropriately selecting units from among the units (a) and units (b) mentioned above. Moreover, in cases where the unit (a) and/or the unit (b) include two or more types of units, by regarding the one or more units that constitute the unit (a) or the unit (b) as units contained in a number of structures corresponding to the molar proportions thereof, it is possible to calculate the Hansen solubility parameter of the unit (a) or unit (b) in the same way as in the method described above, and the difference is calculated on the basis of these values.

In addition, from the perspective of lubrication performance of the obtained lubricant composition, the organic fine particles used in the lubricant composition according to the present invention preferably contain at least one type of unit (a) represented by the formula (5), at least one type of unit (b-1) represented by the formula (4) and a unit (b-2) obtained by polymerizing an aromatic vinyl monomer having 8 to 14 carbon atoms. Here, the specific structures of the unit (a), the unit (b-1) and the unit (b-2) can be selected from among the structures described above.

In cases where the organic fine particles include a unit (a), a unit (b-1) and a unit (b-2) as constituent units, units other than the unit (a), the unit (b-1) and the unit (b-2) may be contained in the copolymer, but from the perspective of lubrication performance of the obtained lubricant composition, it is preferable for the total proportion of the unit (a), the unit (b-1) and the unit (b-2) to be 90 mol % or more of all the units that constitute the copolymer, and a copolymer substantially consisting of the unit (a), the unit (b-1) and the unit (b-2) is most preferred. Here, in cases where at least one of the unit (a), the unit (b-1) and the unit (b-2) contains two or more types of unit, the total molar quantities thereof are calculated as the molar quantities of the unit (a), the unit (b-1) or the unit (b-2).

In cases where the organic fine particles include a copolymer containing the unit (a), the unit (b-1) and the unit (b-2) as constituent units, the compositional ratio of the unit (a), the unit (b-1) and the unit (b-2) in the copolymer is not particularly limited, but (a):(b-1):(b-2) is preferably 10 to 70:1 to 80:1 to 89, more preferably 10 to 50:5 to 80:5 to 80, further preferably 10 to 40:10 to 60:20 to 80, and yet more preferably 10 to 30:10 to 40:40 to 80, provided that the sum of the molar proportions taken to be 100. By setting the compositional ratio of the unit (a), the unit (b-1) and the unit (b-2) to fall within such ranges, it is possible to advantageously control the solubility and dispersibility of the copolymer, facilitate adjustment of the interaction energies in the copolymer within the specified ranges, and better manifest the lubrication performance of the obtained lubricant composition.

Even in cases where the organic fine particles include a copolymer containing the unit (a), the unit (b-1) and the unit (b-2) as constituent units, the bonding form in the copolymer is not particularly limited, and the copolymer may be a block copolymer, a random copolymer or a block/random copolymer. In addition, the weight average molecular weight of the copolymer (A) is 1,000 to 500,000, preferably 3,000 to 300,000, and more preferably 5,000 to 200,000. If the weight average molecular weight falls within such a range, lubrication performance of the obtained lubricant composition can be better manifested.

In cases where the organic fine particles include a copolymer containing the unit (a), the unit (b-1) and the unit (b-2) as constituent units, the difference between the polarity term $\delta_p$ of the Hansen solubility parameter of the unit (a) and the polarity term $\delta_p$ of the Hansen solubility parameter of the unit (b), which includes the unit (b-1) and the unit (b-2), is preferably 0.1 to 12.0 $(MPa)^{1/2}$, more preferably 0.2 to 8.0 $(MPa)^{1/2}$, and particularly preferably 0.5 to 6.0 $(MPa)^{1/2}$ from the perspective of lubrication performance of the obtained lubricant composition. It is possible to advantageously control the solubility and dispersibility of the copolymer and better manifest the lubrication performance of the obtained lubricant composition. The difference in the polarity term of the Hansen solubility parameter can be adjusted by appropriately selecting units from among the units (a), units (b-1) and units (b-2) mentioned above. Moreover, with respect to the solubility parameter of the unit (b), which includes the unit (b-1) and the unit (b-2), and the solubility parameter of the unit (a) in cases where the unit (a) includes two or more types of unit, by regarding the one or more units that constitute the unit (a) or the unit (b) as units contained in a number of structures corresponding to the molar proportions thereof, it is possible to calculate these solubility parameters in the same way as in the method described above, and the difference is calculated on the basis of these values.

The organic fine particles used in the lubricant composition according to the present invention are characterized in that the proportion of particles having diameters of 10 nm to 10 μm is 90% or more on a volume basis. Here, the "particle diameter" mentioned in this specification indicates the particle diameters of organic fine particles, as observed in a state where the particles are dispersed in the base oil, and is measured using a dynamic light scattering method. By calculating the ratio of particles having diameters of 10 nm to 10 μm relative to the total number of particles on a volume basis from these particle diameter measurement results, it is possible to calculate the proportion of particles having diameters of 10 nm to 10 μm. Moreover, even in cases where the target particle diameter range is different from that mentioned above, the ratio of particles having a specified particle diameter can be calculated using the same procedure.

Because organic fine particles substantially consisting of the three elements of carbon, hydrogen and oxygen are present by being dispersed at such a particle diameter in the base oil, the lubricant composition according to the present invention exhibits higher lubrication performance as a result of a mechanism that is different from that of conventional extreme pressure agents and the like. From the perspective of lubrication performance, it is preferable for the proportion of organic fine particles having diameters of 50 nm to 5 μm to be 90% or more, it is more preferable for the proportion of organic fine particles having diameters of 100 nm to 2 μm to be 90% or more, and it is further preferable for the proportion of organic fine particles having diameters of 150 nm to 1 μm to be 90% or more. In addition, from the perspective of lubrication performance, the proportion of particles having particle diameters within such a range is preferably 95% or more, and more preferably 99% or more. The particle diameter of the organic fine particles can be adjusted by means of a method including adjusting the polymerization conditions or polymerization time of the polymerizable monomers, a method including removing organic fine particles having the specified particle diameter following polymerization, or the like.

Moreover, the method for producing the organic fine particles used in the lubricant composition according to the present invention is not particularly limited, with the organic fine particles able to be produced using any publicly known method, such as subjecting polymerizable monomers to a polymerization reaction using a method such as bulk polymerization, emulsion polymerization, suspension polymerization or solution polymerization. In addition, in cases where a friction-decreasing compound is used by being added to a base oil such as a mineral oil or synthetic oil, it is preferable to carry out bulk polymerization or solution polymerization, and more preferably solution polymerization, rather than a polymerization method in which water is used as a solvent, such as emulsion polymerization or suspension polymerization.

A specific method involving solution polymerization should be one including filling a reactor with raw materials including a solvent and polymerizable monomers, increasing the temperature to approximately 50 to 120° C., adding an initiator at a quantity of 0.1 to 10 mol % relative to the total quantity of polymerizable monomers either all at once or in portions, and stirring for approximately 1 to 20 hours so as to bring about a reaction such that the weight average molecular weight of the obtained polymer is, for example, 1,000 to 500,000. In addition, it is possible to charge the polymerizable monomers and a catalyst all at once, and then increase the temperature to 50 to 120° C., and stir for approximately 1 to 20 hours so as to bring about a reaction such that the weight average molecular weight of the obtained polymer is, for example, 1,000 to 500,000.

Examples of solvents able to be used include alcohols such as methanol, ethanol, propanol and butanol; hydrocarbons such as benzene, toluene, xylene and hexane; esters such as ethyl acetate, butyl acetate and isobutyl acetate; ketones such as acetone, methyl ethyl ketone and methyl isobutyl ketone; ethers such as methoxybutanol, ethoxybutanol, ethylene glycol monomethyl ether, ethylene glycol dimethyl ether, ethylene glycol monobutyl ether, propylene glycol monomethyl ether, propylene glycol dimethyl ether, propylene glycol monobutyl ether and dioxane; mineral oils such as paraffin-based mineral oils, naphthene-based mineral oils, and refined mineral oils obtained by refining these mineral oils by means of hydrorefining, solvent deasphalting, solvent extraction, solvent dewaxing, hydrodewaxing, catalytic dewaxing, hydrocracking, alkali distillation, sulfuric acid washing, China clay treatment, or the like; synthetic oils such as poly-α-olefins, ethylene-α-olefin copolymers, polybutene, alkylbenzene compounds, alkylnaphthalene compounds, polyphenyl ether compounds, alkyl-substituted diphenyl ether compounds, polyol esters, dibasic acid esters, hindered esters, monoesters, gas to liquids (GTL); and mixtures of these.

Examples of initiators able to be used include azo-based initiators such as 2,2'-azobis(2-methylpropionitrile), 2,2'-azobis(2-amidinopropane) dihydrochloride, 2,2'-azobis-(N,N-dimethyleneisobutylamidine) dihydrochloride and 1,1'-azobis(cyclohexyl-1-carbonitrile); hydrogen peroxide; organic peroxides such as benzoyl peroxide, t-butyl hydroperoxide, cumene hydroperoxide, methyl ethyl ketone peroxide and perbenzoic acid; persulfates such as sodium persulfate, potassium persulfate and ammonium persulfate; redox initiators such as hydrogen peroxide-$Fe^{3+}$; and other existing radical initiators.

By containing the base oil and 0.01 to 50 parts by mass of the organic fine particles relative to 100 parts by mass of the base oil, the lubricant composition according to the present invention exhibits extremely high friction reduction performance. From the perspective of lubrication performance of the obtained lubricant composition, the lubricant composition according to the present invention more preferably contains the organic fine particles at a quantity of 0.1 to 30 parts by mass, and further preferably 0.3 to 20 parts by mass, when the mass of base oil is taken to be 100 parts by mass.

In the lubricant composition according to the present invention, the Hansen solubility parameter interaction distance D between the base oil and the copolymer that constitutes the organic fine particles is not particularly limited, but is preferably 5.5 to 21.0 $(MPa)^{1/2}$. Here, the "Hansen solubility parameter interaction distance D" mentioned in this specification is such that, for example, when the Hansen solubility parameters of a compound A are denoted by $\delta_{dA}$, $\delta_{pA}$ and $\delta_{hA}$ and the Hansen solubility parameters of a compound B are denoted by $\delta_{dB}$, $\delta_{pB}$ and $\delta_{hB}$ and the solubility parameters of these compounds are plotted as coordinates defined by three terms in a three-dimensional vector space, the distance between the vector coordinates of the compound A and the compound B is calculated using the following Formula (5) while also taking into account correction based on the effects on solubility caused by the terms:

[Formula 3]

$$D=\{4(\delta_{dA}-\delta_{dB})^2+(\delta_{pA}-\delta_{pB})^2+(\delta_{hA}-\delta_{hB})^2\}^{1/2} \quad (5)$$

The Hansen solubility parameter interaction distance D expresses the ease of mixing/ease of dissolution as a single numerical value when a plurality of substances are mixed, and the substances tend to be better mixed/dissolved as the distance D decreases and the substances tend to be difficult to mix or do not dissolve as the distance D increases. In the present invention, it is possible to advantageously control the solubility and dispersibility of the copolymer, and from the perspective of being able to better manifest lubrication performance of the obtained lubricant composition, the Hansen solubility parameter interaction distance D between the base oil and the copolymer that constitutes the organic fine particles is preferably 5.5 to 21.0 $(MPa)^{1/2}$, more preferably 6.0 to 20.0 $(MPa)^{1/2}$, further preferably 6.5 to 19.0 $(MPa)^{1/2}$ and particularly preferably 7.0 to 18.0 $(MPa)^{1/2}$. Here, the Hansen solubility parameter of the copolymer that constitutes the organic fine particles can be calculated in the same way as the method described above by regarding one or more units that constitute the copolymer as units contained in a number of structures corresponding to the molar proportions thereof.

In addition, in cases where the copolymer that constitutes the organic fine particles includes a copolymer containing at least one type of unit (a) and at least one type of unit (b) selected from the group consisting of the unit (b-1) and the unit (b-2), the Hansen solubility parameter interaction distance D between the base oil and the unit (a) or the unit (b) is not particularly limited, but from the perspectives of being able to advantageously control the solubility and dispersibility of the polymer and being able to better manifest the lubrication performance of the obtained lubricant composition, the Hansen solubility parameter interaction distance D between the base oil and the unit (a), for example, is preferably 4.5 to 6.5 $(MPa)^{1/2}$, and the Hansen solubility parameter interaction distance D between the base oil and the unit (b) is preferably 7.0 to 22.0 $(MPa)^{1/2}$. Here, from the perspective of lubrication performance, the Hansen solubility parameter interaction distance D between the base oil and the unit (a) is more preferably 5.0 to 6.4 $(MPa)^{1/2}$, and further preferably 5.2 to 6.2 $(MPa)^{1/2}$. In addition, from the perspective of lubrication performance, the Hansen solubility parameter interaction distance D between the base oil and the unit (b) is more preferably 7.5 to 20.0 $(MPa)^{1/2}$, and further preferably 8.0 to 18.0 $(MPa)^{1/2}$.

The lubricant composition according to the present invention can be used in any application in which conventional lubricants are used, for example lubricating oils such as engine oils, gear oils, turbine oils, hydraulic fluids, flame retardant hydraulic fluids, refrigerator oils, compressor oils, vacuum pump oils, bearing oils, insulating oils, sliding surface oils, rocket drilling oils, metalworking fluids, plastic working fluids, heat treatment oils and greases, and a variety of fuel oils such as marine fuel oils. Of these, the lubricant composition according to the present invention is preferably used in engine oils, bearing oils and greases, and is most preferably used in engine oils.

In addition, in cases where the lubricant composition according to the present invention is used as a lubricating oil, from perspectives such as friction characteristics, wear characteristics, oxidation stability, temperature stability, storage stability, cleaning properties, rust-proofing properties, corrosion prevention properties and handleability of the lubricating oil, addition of publicly known additives according to the intended use of the lubricating oil is not excluded, and it is possible to add, for example, one or two or more additives such as antioxidants, friction-reducing agents, anti-wear agents, oiliness-improving agents, metal-based cleaning agents, dispersing agents, viscosity index improving agents, pour point depressants, rust inhibitors, corrosion inhibitors, metal deactivators and anti-foaming agents, and these additives can be contained at a total quantity of, for example, 0.01 to 50 mass % relative to the overall quantity of the lubricating oil composition.

Here, examples of antioxidants include phenol-based antioxidants such as 2,6-di-tert-butylphenol (hereinafter, tert-butyl is abbreviated to t-butyl), 2,6-di-t-butyl-p-cresol, 2,6-di-t-butyl-4-methylphenol, 2,6-di-t-butyl-4-ethylphenol, 2,4-dimethyl-6-t-butylphenol, 4,4'-methylene-bis(2,6-di-t-butylphenol), 4,4'-bis(2,6-di-t-butylphenol), 4,4'-bis(2-methyl-6-t-butylphenol), 2,2'-methylene-bis(4-methyl-6-t-butylphenol), 2,2'-methylene-bis(4-ethyl-6-t-butylphenol), 4,4'-butylidene-bis(3-methyl-6-t-butylphenol), 4,4'-isopropylidene-bis(2,6-di-t-butylphenol), 2,2'-methylene-bis(4-methyl-6-cyclohexylphenol), 2,2'-methylene-bis(4-methyl-6-nonylphenol), 2,2'-isobutylidene-bis(4,6-dimethylphenol), 2,6-bis(2'-hydroxy-3'-t-butyl-5'-methylbenzyl)-4-methylphenol, 3-t-butyl-4-hydroxyanisole, 2-t-butyl-4-hydroxyanisole, octyl 3-(4-hydroxy-3,5-di-t-butylphenyl)propionate, stearyl 3-(4-hydroxy-3,5-di-t-butylphenyl)propionate, oleyl 3-(4-hydroxy-3,5-di-t-butylphenyl)propionate, dodecyl 3-(4-hydroxy-3,5-di-t-butylphenyl)propionate, decyl 3-(4-hydroxy-3,5-di-t-butylphenyl)propionate, tetrakis{3-(4-hydroxy-3,5-di-t-butylphenyl)propionyloxymethyl}methane, glycerin 3-(4-hydroxy-3,5-di-t-butylphenyl)propionate monoester, an ester of 3-(4-hydroxy-3,5-di-t-butylphenyl)propionic acid and glycerin monooleyl ether, a diester of 3-(4-hydroxy-3,5-di-t-butylphenyl)propionic acid and butylene glycol, a diester of 3-(4-hydroxy-3,5-di-t-butylphenyl)propionic acid and thiodiglycol, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-p-cresol, 2,6-di-t-butyl-4-(N,N'-dimethylaminomethylphenol), bis(3,5-di-t-butyl-4-hydroxybenzyl) sulfide, tris{(3,5-di-t-butyl-4-hydroxyphenyl)propionyl-oxyethyl} isocyanurate, tris(3,5-butyl-4-hydroxyphenyl) isocyanurate, 1,3,5-tris(3,5-di-t-butyl-4-hydroxybenzyl) isocyanurate, bis{2-methyl-4-(3-n-alkylthiopropionyloxy)-5-t-butylphenyl} sulfides, 1,3,5-tris(4-t-butyl-3-hydroxy-2,6-dimethylbenzyl) isocyanurate, tetraphthaloyl-di(2,6-dimethyl-4-t-butyl-3-hydroxybenzyl sulfide), 6-(4-hydroxy-3,5-di-t-butylanilino)-2,4-bis(octylthio)-1,3,5-triazine, 2,2-thio-{diethyl-bis-3-(3,5-di-t-butyl-4-hydroxyphenyl)} propionate, N,N'-hexamethylene-bis(3,5-di-t-butyl-4-hydroxy-hydrocinnamide), 3,5-di-t-butyl-4-hydroxy-benzylphosphoric acid diester, bis(3-methyl-4-hydroxy-5-t-butylbenzyl) sulfide, 3,9-bis[1,1-dimethyl-2-{β-(3-t-butyl-4-hydroxy-5-methylphenyl)propionyloxy}ethyl]-2,4,8,10-tetraoxaspiro[5,5]undecane, 1,1,3-tris(2-methyl-4-hydroxy-5-t-butylphenyl)butane, 1,3,5-trimethyl-2,4,6-tris(3,5-di-t-butyl-4-hydroxybenzyl)benzene and bis{3,3'-bis-(4'-hydroxy-3'-t-butylphenyl)butyric acid} glycol ester; naphthylamine-based antioxidants such as 1-naphthylamine, phenyl-1-naphthylamine, p-octylphenyl-1-naphthylamine, p-nonylphenyl-1-naphthylamine, p-dodecylphenyl-1-naphthylamine and phenyl-2-naphthylamine; phenylenediamine-based antioxidants such as N,N'-diisopropyl-p-phenylenediamine, N,N'-diisobutyl-p-phenylenediamine, N,N'-diphenyl-p-phenylenediamine, N,N'-di-β-naphthyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine and phenyloctyl-p-phenylenediamine; diphenylamine-based antioxidants such as dipyridylamine, diphenylamine, p,p'-di-n-butyldiphenylamine, p,p'-di-t-butyldiphenylamine, p,p'-di-t-pentyldiphenylamine, p,p'-dioctyldiphenylamine, p,p'-dinonyldiphenylamine, p,p'-didecyldiphenylamine, p,p'-didodecyldiphenylamine, p,p'-distyryldiphenylamine, p,p'-dimethoxydiphenylamine, 4,4'-bis(4-α,α-dimethylbenzoyl) diphenylamine, p-isopropoxydiphenylamine and dipyridylamine; phenothiazine-based antioxidants such as phenothiazine, N-methyl phenothiazine, N-ethyl phenothiazine, 3,7-dioctyl phenothiazine, phenothiazine carboxylic acid esters and phenoselenazine; and zinc dithiophosphates. The blending quantity of these antioxidants is preferably 0.01 to 5 mass %, and more preferably 0.05 to 4 mass %, relative to the base oil.

In addition, examples of friction-reducing agents include organic molybdenum compounds such as molybdenum dithiocarbamates and molybdenum dithiophosphates. Examples of molybdenum dithiocarbamates include a compound represented by the following formula (6) below:

[Chemical Formula 6]

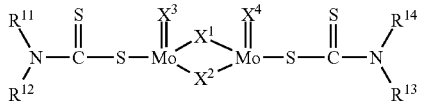

(6)

wherein, $R^{11}$ to $R^{14}$ each independently represent a hydrocarbon group having 1 to 20 carbon atoms and $X^1$ to $X^4$ each independently represent a sulfur atom or an oxygen atom.

In the formula (6), $R^{11}$ to $R^{14}$ each independently denote a hydrocarbon group having 1 to 20 carbon atoms, and examples of such groups include saturated aliphatic hydrocarbon groups such as methyl groups, ethyl groups, propyl groups, butyl groups, pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, nonadecyl groups, eicosyl group and isomers of all of these groups; unsaturated aliphatic hydrocarbon groups such as ethenyl groups (vinyl groups), propenyl groups (allyl groups), butenyl groups, pentenyl groups, hexenyl groups, heptenyl groups, octenyl groups, nonenyl groups, decenyl groups, undecenyl groups, dodecenyl groups, tridecenyl groups, tetradecenyl groups, pentadecenyl groups, hexadecenyl groups, heptadecenyl groups, octadecenyl groups, nonadecenyl groups, eicosenyl groups and isomers of all of these groups; aromatic hydrocarbon groups such as phenyl groups, toluyl groups, xylyl groups, cumenyl groups, mesityl groups, benzyl groups, phenethyl groups, styryl groups, cinnamyl groups, benzhydryl groups, trityl groups, ethylphenyl groups, propylphenyl groups, butylphenyl groups, pentylphenyl groups, hexylphenyl groups, heptylphenyl groups, octylphenyl groups, nonylphenyl groups, decylphenyl groups, undecylphenyl groups, dodecylphenyl groups, styrenated phenyl groups, p-cumylphenyl groups, phenylphenyl groups, benzylphenyl groups, α-naphthyl groups, β-naphthyl group and isomers of all of these groups; and cycloalkyl groups such as cyclopentyl groups, cyclohexyl groups, cycloheptyl groups, methylcyclopentyl groups, methylcyclohexyl groups, methylcycloheptyl groups, cyclopentenyl groups, cyclohexenyl groups, cycloheptenyl groups, methylcyclopentenyl groups, methylcyclohexenyl groups, methylcycloheptenyl groups and isomers of all of these groups. Of these, saturated aliphatic hydrocarbon groups and unsaturated aliphatic hydrocarbon groups are preferred, saturated aliphatic hydrocarbon groups are more preferred, and saturated aliphatic hydrocarbon groups having 3 to 15 carbon atoms are most preferred.

In addition, in the formula (6), $X^1$ to $X^4$ each independently represent a sulfur atom or an oxygen atom. Of these, it is preferable for $X^1$ and $X^2$ to be sulfur atoms, and more preferable for $X^1$ and $X^2$ to be sulfur atoms and $X^3$ and $X^4$ to be oxygen atoms.

Moreover, the blending quantity of these friction-reducing agents is preferably 50 to 3,000 ppm by mass, more preferably 100 to 2,000 ppm by mass, and further preferably 200 to 1,500 ppm by mass in terms of molybdenum content relative to the base oil.

Furthermore, examples of anti-wear agents include sulfur-based additives such as sulfurized oils and fats, olefin polysulfides, sulfurized olefins, dibenzyl sulfide, ethyl-3-[[bis(1-methylethoxy)phosphinothioyl]thio] propionate, tris-[(2 or 4)-isoalkylphenol]thiophosphates, 3-(di-isobutoxy-thiophosphorylsulfanyl)-2-methyl-propionic acid, triphenyl phosphorothionate, β-dithiophosphorylated propionic acid, methylene-bis(dibutyldithiocarbamate), O,O-diisopropyl-dithiophosphorylethyl propionate, 2,5-bis(n-nonyldithio)-1,3,4-thiadiazole, 2,5-bis(1,1,3,3-tetramethylbutanethio)-1,3,4-thiadiazole and 2,5-bis(1,1,3,3-tetramethyldithio)-1,3,4-thiadiazole; phosphorus-based compounds such as monooctyl phosphate, dioctyl phosphate, trioctyl phosphate, monobutyl phosphate, dibutyl phosphate, tributyl phosphate, monophenyl phosphate, diphenyl phosphate, triphenyl phosphate, tricresyl phosphate, monoisopropylphenyl phosphate, diisopropylphenyl phosphate, triisopropylphenyl phosphate, mono-tert-butylphenyl phosphate, di-tert-butylphenyl phosphate, tri-tert-butylphenyl phosphate, triphenyl thiophosphate, monooctyl phosphite, dioctyl phosphite, trioctyl phosphite, monobutyl phosphite, dibutyl phosphite, tributyl phosphite, monophenyl phosphite, diphenyl phosphite, triphenyl phosphite, monoisopropylphenyl phosphite, diisopropylphenyl phosphite, triisopropylphenyl phosphite, mono-tert-butylphenyl phosphite, di-tert-butylphenyl phosphite and tri-tert-butylphenyl phosphite; organometallic compounds such as zinc dithiophosphates (ZnDTP) represented by general formula (7), metal salts (Sb, Mo etc.) of dithiophosphoric acids, metal salts (Zn, Sb, Mo etc.) of dithiocarbamic acids, metal salts of naphthenoic acid, fatty acid metal salts, metal salts of phosphoric acid, metal salts of phosphoric acid esters and metal salts of phosphorus acid esters; and boron compounds, alkylamine salts of mono- and dihexyl phosphate, amine salts of phosphoric acid esters and mixtures of triphenyl thiophosphoric acid esters and tert-butylphenyl derivatives.

[Chemical Formula 7]

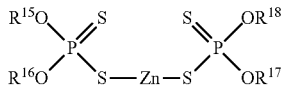

(7)

wherein, $R^{15}$ to $R^{18}$ each independently represent a primary or secondary alkyl group having 1 to 20 carbon atoms or an aryl groups.

In the formula (7) above, $R^{15}$ to $R^{18}$ each independently represent a hydrocarbon group having 1 to 20 carbon atoms, and examples of such groups include primary alkyl groups such as methyl groups, ethyl groups, propyl groups, butyl groups, pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, nonadecyl groups and eicosyl groups; secondary alkyl groups such as secondary propyl groups, secondary butyl groups, secondary pentyl groups, secondary hexyl groups, secondary heptyl groups, secondary octyl groups, secondary nonyl groups, secondary decyl groups, secondary undecyl groups, secondary dodecyl groups, secondary tridecyl groups, secondary tetradecyl groups, secondary pentadecyl groups, secondary hexadecyl groups, secondary heptadecyl groups, secondary octadecyl groups, secondary nonadecyl groups and secondary eicosyl groups; tertiary alkyl groups such as tertiary butyl groups, tertiary pentyl groups, tertiary hexyl groups, tertiary heptyl groups, tertiary octyl groups, tertiary nonyl groups, tertiary decyl groups, tertiary undecyl groups, tertiary dodecyl groups, tertiary tridecyl groups, tertiary tetradecyl groups, tertiary pentadecyl groups, tertiary hexadecyl groups, tertiary heptadecyl groups, tertiary octadecyl groups, tertiary nonadecyl groups and tertiary eicosyl groups; branched alkyl groups such as branched butyl groups (isobutyl groups etc.), branched pentyl groups (isopentyl groups etc.), branched hexyl groups (isohexyl groups), branched heptyl groups (isoheptyl groups), branched octyl groups (isooctyl groups, 2-ethylhexyl groups etc.), branched nonyl groups (isononyl groups etc.), branched decyl groups (isodecyl groups etc.), branched undecyl groups (isoundecyl groups etc.), branched dodecyl groups (isododecyl groups etc.), branched tridecyl groups (isotridecyl groups etc.), branched tetradecyl groups (isotetradecyl groups), branched pentadecyl groups (isopentadecyl groups etc.), branched hexadecyl groups (isohexadecyl groups), branched heptadecyl groups (isoheptadecyl groups etc.), branched octadecyl groups (isooctadecyl groups etc.), branched nonadecyl groups (isononadecyl groups etc.) and branched eicosyl groups (isoeicosyl groups etc.); and aryl groups such as phenyl groups, toluyl groups, xylyl groups, cumenyl groups, mesityl groups, benzyl groups, phenethyl groups, styryl groups, cinnamyl groups, benzhydryl groups, trityl groups, ethylphenyl groups, propylphenyl groups, butylphenyl groups, pentylphenyl groups, hexylphenyl groups, heptylphenyl groups, octylphenyl groups, nonylhenyl groups, decylphenyl groups, undecylphenyl groups, dodecylphenyl groups, styrenated phenyl groups, p-cumylphenyl groups, phenylphenyl groups and benzylphenyl groups. The blending quantity of these wear prevention agents is preferably 0.01 to 3 mass %, and more preferably 0.05 to 2 mass %, relative to the base oil.

In addition, examples of oiliness-improving agents include higher alcohols such as oleyl alcohol and stearyl alcohol; fatty acids such as oleic acid and stearic acid; esters such as oleyl glycerin ester, stearyl glycerin ester and lauryl glyceryl ester; amides such as laurylamide, oleylamide and stearylamide; amines such as laurylamine, oleylamine and stearylamine; and ethers such as lauryl glycerin ether and oleyl glycerin ether. The blending quantity of these oiliness-improving agents is preferably 0.1 to 5 mass %, and more preferably 0.2 to 3 mass %, relative to the base oil.

Furthermore, examples of cleaning agents include sulfonates, phenates, salicylates and phosphates of calcium, magnesium, barium and the like, and superbasic salts of these. Of these, superbasic salts are preferred, and among superbasic salts, salts having a TBN (total base number) of 30 to 500 mg KOH/g are more preferred. Furthermore, salicylate-based cleaning agents containing no phosphorus or sulfur atoms are preferred. The blending quantity of these cleaning agents is preferably 0.5 to 10 mass %, and more preferably 1 to 8 mass %, relative to the base oil.

In addition, any ash-free dispersing agents used in lubricating oils can be used without particular limitation as ash-free dispersing agents, but examples thereof include nitrogen-containing compounds having at least one straight chain or branched chain alkyl group or alkenyl group having 40 to 400 carbon atoms in the molecule, and derivatives thereof. Specific examples thereof include succinimide, succinimide, succinic acid esters, succinic acid ester-amides, benzylamine, polyamines, polysuccinimide and Mannich bases, and examples of derivatives thereof include compounds obtained by causing boron compounds such as boric acid and borates, phosphorus compounds such as thiophosphoric acid and thiophosphates, organic acids, hydroxypolyoxyalkylene carbonates, and the like, to act on these nitrogen-containing compounds. In cases where the number of carbon atoms in an alkyl group or alkenyl group is less than 40, solubility of the compound in a lubricant base oil may decrease, but in cases where the number of carbon atoms in an alkyl group or alkenyl group exceeds 400, the low-temperature fluidity of a lubricating oil composition may deteriorate. The blending quantity of these ash-free dispersing agents is preferably 0.5 to 10 mass %, and more preferably 1 to 8 mass %, relative to the base oil.

Furthermore, examples of viscosity index improving agents include poly($C_{1-18}$)alkyl (meth)acrylates, ($C_{1-18}$)alkyl acrylate/($C_{1-18}$)alkyl (meth)acrylate copolymers, diethylaminoethyl (meth)acrylate/($C_{1-18}$)alkyl (meth)acrylate copolymers, ethylene/($C_{1-18}$)alkyl (meth)acrylate copolymers, polyisobutylene, polyalkylstyrenes, ethylene/propylene copolymers, styrene/maleic acid ester copolymers and hydrogenated styrene/isoprene copolymers. In addition, branched or polyfunctional viscosity index improving agents that impart dispersion performance may be used. The weight average molecular weight of the viscosity index improving agent is not particularly limited, but is, for example, approximately 10,000 to 1,500,000. The blending quantity of these viscosity index improving agents is preferably 0.1 to 20 mass % relative to the base oil. This blending quantity is more preferably 0.3 to 15 mass %.

In addition, examples of pour point depressants include poly(alkyl methacrylates), poly(alkyl acrylates), polyalkylstyrenes and poly(vinyl acetate), and the weight average molecular weight thereof is 1,000 to 100,000. The blending quantity of these pour point depressants is preferably 0.005 to 3 mass %, and more preferably 0.01 to 2 mass %, relative to the base oil.

Furthermore, examples of rust inhibitors include sodium nitrite, calcium salts of oxidized paraffin wax, magnesium salts of oxidized paraffin wax, alkali metal salts, alkaline earth metal salts and amine salts of beef tallow fatty acids, alkenyl succinic acids and alkenyl succinic acid half esters (in which the molecular weight of alkenyl groups is approximately 100 to 300), sorbitan monoesters, nonylphenol ethoxylate and calcium salts of lanolin fatty acids. The blending quantity of these rust inhibitors is preferably 0.01 to 3 mass %, and more preferably 0.02 to 2 mass %, relative to the base oil.

In addition, examples of corrosion inhibitors and metal deactivators include triazole, tolyltriazole, benzotriazole, benzimidazole, benzothiazole, benzothiadiazole and derivatives of these compounds, such as 2-hydroxy-N-(1H-1,2,4-triazol-3-yl)benzamide, N,N-bis(2-ethylhexyl)-[(1,2,4-triazol-1-yl)methyl]amine, N,N-bis(2-ethylhexyl)-[(1,2,4-triazol-1-yl)methyl]amine and 2,2'-[[(4 or 5 or 1)-(2-ethylhexyl)-methyl-1H-benzotriazol-1-methyl]imino] bisethanol, and other examples include bis(poly-2-carboxyethyl)phosphinic acid, hydroxyphosphonoacetic acid, tetraalkylthiuram disulfides, N'1,N'12-bis(2-hydroxybenzoyl)dodecane dihydrazide, 3-(3,5-di-t-butyl-hydroxyphenyl)-N'-(3-(3,5-di-tert-butyl-hydroxyphenyl)propanoyl) propane hydrazide, an ester of tetrapropenylsuccinic acid and 1,2-propane diol, disodium sebacate, (4-nonylphenoxy) acetic acid, alkylamine salts of mono- and di-hexylphosphate, a sodium salt of tolyltriazole and (Z)—N-methyl-N-(1-oxo-9-octadecenyl)glycine. The blending quantity of these corrosion inhibitors and metal deactivators is preferably 0.01 to 3 mass %, and more preferably 0.02 to 2 mass %, relative to the base oil.

Furthermore, examples of anti-foaming agents include polydimethylsilicone, dimethylsilicone oils, trifluoropropylmethylsilicone, colloidal silica, poly(alkyl acrylates), poly (alkyl methacrylates), alcohol ethoxy/propoxylates, fatty acid ethoxy/propoxylates and sorbitan partial fatty acid esters. The blending quantity of these anti-foaming agents is preferably 0.001 to 0.1 mass %, and more preferably 0.001 to 0.01 mass %, relative to the base oil.

Moreover, the lubricating oil composition according to the present invention can be used in lubricating oils for motor vehicles (for example, gasoline engine oils and diesel engine oils for motor vehicles and motorcycles), and industrial lubricating oils (for example, gear oils, turbine oils, oil film bearing oils, lubricating oils for refrigerators, vacuum pump oils, lubricating oils for compressors and multipurpose lubricating oils). Of these, the lubricating oil composition according to the present invention can be used advantageously in lubricating oils for motor vehicles.

EXAMPLES

The present invention will now be explained in greater detail through the use of examples, but is in no way limited to these examples.

The Hansen solubility parameters ($\delta_d$, $\delta_p$ and $\delta_h$) and Hildebrand solubility parameters ($\delta$) of polymerizable monomers able to be advantageously used to synthesize organic fine particles that constitute the lubricant composition according to the present invention are shown in Table 3.

TABLE 3

| Polymerizable monomer | Solubility parameter $(MPa)^{1/2}$ | | | |
|---|---|---|---|---|
| | $\delta_d$ | $\delta_p$ | $\delta_h$ | $\delta$ |
| Decyl acrylate | 17.1 | 2.3 | 5.8 | 18.2 |
| Lauryl acrylate | 17.1 | 2.0 | 5.4 | 18.0 |
| Cetyl acrylate | 17.0 | 1.6 | 4.8 | 17.7 |
| Stearyl acrylate | 17.0 | 1.4 | 4.5 | 17.6 |
| Hydroxyethyl acrylate | 19.8 | 9.3 | 18.9 | 28.9 |
| Methyl acrylate | 17.9 | 7.6 | 10.4 | 22.0 |
| Styrene | 20.4 | 1.2 | 1.5 | 20.5 |

Polymerizable Monomers Used
Lauryl acrylate [constituent material of unit (a)]
Hydroxyethyl acrylate [constituent material of unit (b-1)]
Styrene [constituent material of unit (b-2)]

Production Example 1

44.1 g of a highly refined base oil (a hydrocarbon-based oil having 20 to 50 carbon atoms, viscosity index=112, $\delta_d$=16.3, $\delta_p$=0, $\delta_h$=0, $\delta$=16.3) as a base oil and 21.8 g of butyl acetate were placed in a reaction vessel and heated to a temperature of 110° C. 174.0 g of lauryl acrylate and 22.0 g of hydroxyethyl acrylate as polymerizable monomers, 14.7 g of butyl acetate and 1.4 g of 2,2-azobisisobutyronitrile were added dropwise to the reaction vessel and stirred for a period of 2 hours. Next, while maintaining a temperature of 75° C. to 85° C., 284.1 g of styrene, 75.9 g of lauryl acrylate and 28.2 g of hydroxyethyl acrylate as polymerizable monomers and 5.2 g of 2,2-azobisisobutyronitrile were added dropwise and stirred for a period of 4 hours so as to bring about a polymerization reaction. Next, 344 g of a base oil was added and unreacted polymerizable monomers and butyl acetate were removed while increasing the temperature to 115° C. to 125° C., thereby preparing an organic fine particle-dispersed solution in which organic fine particles including a copolymer were dispersed in the base oil at a quantity of 50 parts by mass relative to the overall mass. The Hansen solubility parameter interaction distance between the base oil and the copolymer constituting these organic fine particles was 7.9 $(MPa)^{1/2}$, the Hansen solubility parameter interaction distance between the base oil and the unit (a) that constitutes this copolymer was 6.0 $(MPa)^{1/2}$, and the Hansen solubility parameter interaction distance between the base oil and the unit (b) was 11.0 $(MPa)^{1/2}$.

Production Example 2

A solution (an organic fine particle-dispersed solution) in which a copolymer was completely dissolved in the base oil at a quantity of 50 parts by mass relative to the overall mass was prepared by altering the molar ratio of the constituent units in the manner shown in Table 4 below by altering the molar ratio of the polymerizable monomers used in Production Example 1. The Hansen solubility parameter interaction distance between the base oil and this copolymer was 9.4 $(MPa)^{1/2}$, the Hansen solubility parameter interaction distance between the base oil and the unit (a) that constitutes this copolymer was 6.0 $(MPa)^{1/2}$, and the Hansen solubility parameter interaction distance between the base oil and the unit (b) was 22.2 $(MPa)^{1/2}$.

The particle size distribution of organic fine particles in the dispersed solutions prepared in Production Examples 1 and 2 was measured on a volume basis using a particle size distribution analyzer (an ELSZ-1000 available from Otsuka Electronics Co., Ltd.), and these results are also shown in Table 4. In addition, the molar ratios of polymerizable monomers used in the copolymers, the weight average molecular weights determined by means of GPC in terms of styrene, and the solubility parameters calculated using the Fedors method and the van Krevelen & Hoftyzer method are also shown in Table 4.

TABLE 4

| | | | Production Example 1 | Production Example 2 |
|---|---|---|---|---|
| Constituent units | Compositional molar proportions | (a) | 0.25 | 0.64 |
| | | (b-1) | 0.10 | 0.36 |
| | | (b-2) | 0.65 | 0 |
| Copolymer | Weight average molecular weight | | 47000 | 250000 |
| | Solubility parameter $(MPa)^{1/2}$ | $\delta_d$ | 18.8 | 17.5 |
| | | $\delta_p$ | 1.25 | 2.2 |
| | | $\delta_h$ | 6.08 | 8.9 |
| | | $\delta$ | 19.8 | 19.7 |
| Lubricant composition | Particle size distribution (%) | <10 nm | 0 | Dissolved (measurement not possible) |
| | | ≥10 nm, <50 nm | 0 | |
| | | ≥50 nm, <100 nm | 0 | |
| | | ≥100 nm, <150 nm | 0 | |
| | | ≥150 nm, <200 nm | 0 | |
| | | ≥200 nm, <250 nm | 0 | |
| | | ≥250 nm, <300 nm | 14.3 | |
| | | ≥300 nm, <400 nm | 23.3 | |
| | | ≥400 nm, <500 nm | 32.0 | |
| | | ≥500 nm, <600 nm | 18.2 | |
| | | ≥600 nm, <700 nm | 8.2 | |
| | | ≥700 nm, <1000 nm | 3.0 | |
| | | ≥1 μm, <5 μm | 1.0 | |
| | | ≥5 μm, <10 μm | 0 | |
| | | ≥10 μm | 0 | |

<Evaluation of Friction Decrease Characteristics>

Lubricant compositions containing a copolymer at a quantity of 0.5 mass % relative to 100 parts by mass of a base oil and containing a molybdenum dithiocarbamate at a quantity of 800 ppm in terms of molybdenum were produced by diluting the organic fine particle-dispersed solutions produced in Production Examples 1 and 2 with a base oil and then adding the molybdenum dithiocarbamate. A lubricant composition obtained using glycerin monooleate instead of the copolymers produced in Production Examples 1 and 2 (here, the glycerin monooleate completely dissolved in the base oil) and a lubricant composition containing no copolymer were produced as comparative examples.

The coefficients of friction of these lubricant compositions were measured under the following test conditions using a frictional wear tester (HEIDEN TYPE: HHS2000, available from Shinto Scientific Co., Ltd.). The coefficient of friction is an average value for coefficient of friction obtained from 15 reciprocations prior to completion of the test. The test results are shown in Table 5.

Test Conditions

Load: 9.8 N

Maximum contact pressure: $1.25\times10^{-7}$ Pa

Sliding speed: 5 mm/sec

Amplitude: 20 mm

Test number: 50 reciprocations

Test temperature: 40° C.

Sliding speed: 5 mm/sec

Top plate: AC8A-T6

Bottom plate: SUJ2

TABLE 5

| | Example 1 | Comparative example 1 | Comparative example 2 | Comparative example 3 |
|---|---|---|---|---|
| Organic fine particles | Copolymer of Production Example 1 | Copolymer of Production Example 2 | Glycerin monooleate | Not contained |

TABLE 5-continued

| | Example 1 | Comparative example 1 | Comparative example 2 | Comparative example 3 |
|---|---|---|---|---|
| Coefficient of friction | 0.030 | 0.044 | 0.036 | 0.052 |

The examples given above show that the lubricant composition according to the present invention achieves a high friction decrease effect by means of organic fine particles including a copolymer dispersed in the lubricant composition, and when the lubricant composition according to the present invention is used in combination with a molybdenum compound used in the past as a friction-reducing agent, it is understood that this advantageous effect is not impaired and it is possible to obtain a lubricant composition that exhibits a superior friction decrease effect in comparison with a case in which only a molybdenum compound is used.

Production Examples 3 to 11

Organic fine particle-dispersed solutions were produced using a similar method to that used in Production Example 1, except that the molar ratios of the constituent units were altered in the manner shown in Table 6 by altering the molar ratios of the polymerizable monomers used and the reaction time was adjusted as appropriate. The weight average molecular weights, as determined by means of GPO in terms of styrene, of the copolymers constituting the organic fine particles, the solubility parameters calculated using the Fedors method and the van Krevelen & Hoftyzer method, and the Hansen solubility parameter interaction distances from the base oil are shown in Table 6. In addition, the particle size distribution of the organic fine particles in the organic fine particle-dispersed solutions was measured using the method described above, and these results are shown in Table 6.

TABLE 6

| | | | Production Example 3 | Production Example 4 | Production Example 5 | Production Example 6 | Production Example 7 |
|---|---|---|---|---|---|---|---|
| Constituent units | Compositional molar proportions | (a) | 0.25 | 0.59 | 0.44 | 0.44 | 0.60 |
| | | (b-1) | 0.11 | 0.16 | 0.14 | 0.14 | 0.20 |
| | | (b-2) | 0.65 | 0.25 | 0.42 | 0.42 | 0.20 |
| Copolymer | Weight average molecular weight | | 38000 | 50000 | 115000 | 85000 | 63000 |
| | Solubility parameter $(MPa)^{1/2}$ | $\delta_d$ | 18.80 | 17.68 | 18.08 | 18.08 | 17.64 |
| | | $\delta_p$ | 1.27 | 17.50 | 1.56 | 1.56 | 1.83 |
| | | $\delta_h$ | 6.17 | 6.89 | 6.69 | 6.69 | 7.35 |
| | | $\delta$ | 19.82 | 19.06 | 19.34 | 19.34 | 19.20 |
| Hansen solubility parameter interaction distance | Unit (a) to base oil | | 5.98 | 5.98 | 5.98 | 5.98 | 5.98 |
| | Unit (b) to base oil | | 10.69 | 14.08 | 12.18 | 12.18 | 15.53 |
| | Copolymer to base oil | | 8.04 | 7.63 | 7.74 | 7.74 | 8.04 |
| Lubricant composition | Particle size distribution (%) | <10 nm | 0 | 0 | 0 | 0 | 0 |
| | | ≥10 nm, <50 nm | 0 | 0 | 0 | 0 | 0 |
| | | ≥50 nm, <100 nm | 0 | 0 | 0 | 0 | 0 |
| | | ≥100 nm, <150 nm | 0 | 0 | 0 | 0 | 0 |
| | | ≥150 nm, <200 nm | 0 | 13.0 | 13.8 | 13.7 | 0 |
| | | ≥200 nm, <250 nm | 13.0 | 21.1 | 25.8 | 22.3 | 0 |
| | | ≥250 nm, <300 nm | 21.2 | 28.9 | 26.6 | 30.6 | 13.5 |
| | | ≥300 nm, <400 nm | 29.1 | 17.7 | 17.6 | 17.7 | 21.9 |
| | | ≥400 nm, <500 nm | 21.6 | 9.6 | 9.0 | 8.7 | 30.1 |
| | | ≥500 nm, <600 nm | 9.9 | 5.1 | 4.1 | 4.1 | 17.4 |
| | | ≥600 nm, <700 nm | 3.9 | 2.6 | 2.0 | 1.9 | 8.9 |
| | | ≥700 nm, <1000 nm | 0.9 | 1.2 | 0.8 | 0.8 | 4.5 |
| | | ≥1 μm, <5 μm | 0.2 | 0.8 | 0.3 | 0.1 | 3.8 |
| | | ≥5 μm, <10 μm | 0 | 0 | 0 | 0 | 0 |
| | | ≥10 μm | 0 | 0 | 0 | 0 | 0 |

TABLE 6-continued

| | | | Production Example 8 | Production Example 9 | Production Example 10 | Production Example 11 |
|---|---|---|---|---|---|---|
| Constituent units | Compositional molar proportions | (a) | 0.16 | 0.16 | 0.32 | 0.23 |
| | | (b-1) | 0.04 | 0.09 | 0.00 | 0.00 |
| | | (b-2) | 0.80 | 0.75 | 0.68 | 0.77 |
| Copolymer | Weight average molecular weight | | 29000 | 50000 | 39000 | 36000 |
| | Solubility parameter $(MPa)^{1/2}$ | $\delta_d$ | 19.28 | 19.25 | 18.56 | 18.94 |
| | | $\delta_p$ | 1.06 | 1.15 | 1.25 | 1.12 |
| | | $\delta_h$ | 4.55 | 5.72 | 4.14 | 3.73 |
| | | $\delta$ | 19.83 | 20.11 | 19.06 | 19.34 |
| Hansen solubility parameter interaction distance | Unit (a) to base oil | | 5.98 | 5.98 | 5.98 | 5.98 |
| | Unit (b) to base oil | | 9.24 | 10.14 | 8.49 | 8.49 |
| | Copolymer to base oil | | 7.57 | 8.29 | 6.25 | 6.58 |
| Lubricant composition | Particle size distribution (%) | <10 nm | 0 | 0 | 0 | 0 |
| | | <10 nm, <50 nm | 0 | 0 | 0 | 0 |
| | | ≥50 nm, <100 nm | 0 | 0 | 0 | 0 |
| | | ≥100 nm, <150 nm | 0 | 0 | 0 | 0 |
| | | ≥150 nm, <200 nm | 0 | 0 | 0 | 13.2 |
| | | ≥200 nm, <250 nm | 0 | 0 | 0 | 21.5 |
| | | ≥250 nm, <300 nm | 13.7 | 0 | 0 | 29.4 |
| | | ≥300 nm, <400 nm | 22.3 | 0 | 0 | 20.8 |
| | | ≥400 nm, <500 nm | 30.6 | 0 | 12.9 | 9.4 |
| | | ≥500 nm, <600 nm | 19.8 | 0 | 21.1 | 4.1 |
| | | ≥600 nm, <700 nm | 8.9 | 0 | 28.9 | 1.2 |
| | | ≥700 nm, <1000 nm | 3.6 | 14.3 | 19.2 | 0.4 |
| | | ≥1 μm, <5 μm | 1.1 | 85.7 | 17.8 | 0 |
| | | ≥5 μm, <10 μm | 0 | 0 | 0 | 0 |
| | | ≥10 μm | 0 | 0 | 0 | 0 |

Production Example 12

An organic fine particle-dispersed solution was produced using a similar method to that used in Production Example 1, except that the molar ratios of the constituent units were altered in the manner shown in Table 7 by altering the molar ratios of the polymerizable monomers used and the reaction time was adjusted as appropriate. For the copolymer that constitutes the organic fine particles, the solubility parameters calculated using the Fedors method and the van Krevelen & Hoftyzer method and the Hansen solubility parameter interaction distances from the base oil are shown in Table 7. In addition, the particle size distribution of the organic fine particles in the organic fine particle-dispersed solution was measured using the method described above, and these results are shown Table 7.

TABLE 7

| | | | Production Example 12 |
|---|---|---|---|
| Constituent units | Compositional molar proportions | (a) | 0.25 |
| | | (b-1) | 0.38 |
| | | (b-2) | 0.38 |
| Copolymer | Solubility parameter $(MPa)^{1/2}$ | $\delta_d$ | 18.64 |
| | | $\delta_p$ | 2.40 |
| | | $\delta_h$ | 9.89 |
| | | $\delta$ | 21.21 |
| Hansen solubility parameter interaction distance | Unit (a) to base oil | | 5.98 |
| | Unit (b) to base oil | | 15.53 |
| | Copolymer to base oil | | 11.20 |
| Lubricant composition | Particle size distribution (%) | <10 nm | 0 |
| | | ≥10 nm, <50 nm | 0 |
| | | ≥50 nm, <100 nm | 0 |
| | | ≥100 nm, <150 nm | 0 |
| | | ≥150 nm, <200 nm | 0 |
| | | ≥200 nm, <250 nm | 0 |
| | | ≥250 nm, <300 nm | 22.4 |
| | | ≥300 nm, <400 nm | 30.7 |
| | | ≥400 nm, <500 nm | 24.2 |
| | | ≥500 nm, <600 nm | 12 |

TABLE 7-continued

| | Production Example 12 |
|---|---|
| ≥600 nm, <700 nm | 5.9 |
| ≥700 nm, <1000 nm | 2.9 |
| ≥1 μm, <5 μm | 1.9 |
| ≥5 μm, <10 μm | 0 |
| ≥10 μm | 0 |

The organic fine particle-dispersed solutions of Production Examples 3 to 12, like the organic fine particle-dispersed solution of Production Example 1, contained organic fine particles at a quantity of 0.01 to 50 parts by mass relative to 100 parts by mass of the base oil, and could be used as lubricant compositions that exhibit high lubrication performance. In addition, additives such as molybdenum dithiocarbamates may be added and used according to need.

The invention claimed is:

1. A lubricant composition, containing:

a base oil; and organic fine particles substantially consisting of the three elements of carbon, hydrogen and oxygen and having a proportion of particles having a particle diameter of 150 nm to 5 μm of 90% or greater, wherein a content of the organic fine particles is 0.01 to 50 parts by mass relative to 100 parts by mass of the base oil, wherein the organic fine particles comprise a copolymer containing a unit (a) and a unit (b) as constituent units, and wherein a Hansen solubility parameter interaction distance between the base oil and the unit (a) is 5.2 to 6.2 $(MPa)^{1/2}$, and a Hansen solubility parameter interaction distance between the base oil and the unit (b) is 8.0 to 18.0 $(MPa)^{1/2}$, and wherein a weight average molecular weight of the copolymer is 1,000 to 500,000 and a compositional ratio of molar proportions of the unit (a) and the unit (b) is such that (a):(b) is 10 to 70:30 to 90, provided that the sum of the molar proportions is 100.

2. The lubricant composition according to claim 1, wherein a Hildebrand solubility parameter of the base oil is 15.0 to 18.0 $(MPa)^{1/2}$.

3. The lubricant composition according to claim 1, wherein the copolymer has a Hansen solubility parameter interaction distance from the base oil of 5.5 to 21.0 $(MPa)^{1/2}$.

4. A lubricating oil composition containing the lubricant composition according to claim 1.

5. The lubricating oil composition according to claim 4, further containing one or more selected from the group consisting of metal-based cleaning agents, ash-free dispersing agents, anti-wear agents, extreme pressure agents, antioxidants, viscosity index improving agents, pour point depressants, rust inhibitors, corrosion inhibitors, metal deactivators and anti-foaming agents.

* * * * *